United States Patent [19]

Todoroki et al.

[11] 4,201,644

[45] May 6, 1980

[54] REPLENISHMENT OF ELECTRODEPOSITION COATING BATH

[75] Inventors: Nobuaki Todoroki, Warabi; Junichi Yasukawa, Chigasaki; Norio Kawamura, Kawagoe; Akio Kasai, Sayama; Satoru Kamiyama; Toshihiro Kawasaki, both of Tokyo, all of Japan

[73] Assignees: Shinto Paint Co., Ltd., Amagasaki; Honda Motor Co., Ltd.; Taikisha Ltd., both of Tokyo, all of Japan

[21] Appl. No.: 946,956

[22] Filed: Sep. 29, 1978

[51] Int. Cl.[2] ..... C25D 13/24

[52] U.S. Cl. ..... 204/181 C; 204/300 EC

[58] Field of Search ..... 204/181 C, 300 EC

[56] References Cited

U.S. PATENT DOCUMENTS

| | | | |
|---|---|---|---|
| 3,663,404 | 5/1972 | Loop | 204/181 |
| 3,869,366 | 3/1975 | Suzuki et al. | 204/181 C |

*Primary Examiner*—Howard S. Williams

*Attorney, Agent, or Firm*—Wenderoth, Lind & Ponack

[57] ABSTRACT

The present invention relates to a method for replenishing an electrodeposition coating bath by subjecting to an ultrafiltration, an electro-deposition bath liquid which has been decomposed with time under a pressure of 0.2–3.0 kg/cm$^2$ changing the direction of the bath liquid during the ultrafiltration step so as to cause the liquid to flow in opposite directions in the ultrafiltering apparatus; recycling the concentrate obtained from the ultrafiltration to the electrodeposition coating bath for the purpose of adjusting the liquid characteristics of the bath and using the thus-obtained filtrate, obtained from the ultrafiltration, the diluent for preparing a replenishing supply liquid. The deposition bath according to the present invention contains a water thinnable cationic binder resin which is a nitrogen atom-containing basic resin neutralized at least partially with an acid compound and at least one non-ionic resin in the form of a powder which is solid at room temperature, but which is capable of melting, when heated. According to the present invention, the harmful substances are removed from the bath, and the replenishing may be carried out continuously without any serious clogging of the apparatus to produce excellent coating films.

2 Claims, 2 Drawing Figures

REPLENISHMENT OF ELECTRODEPOSITION COATING BATH

Figure 1:
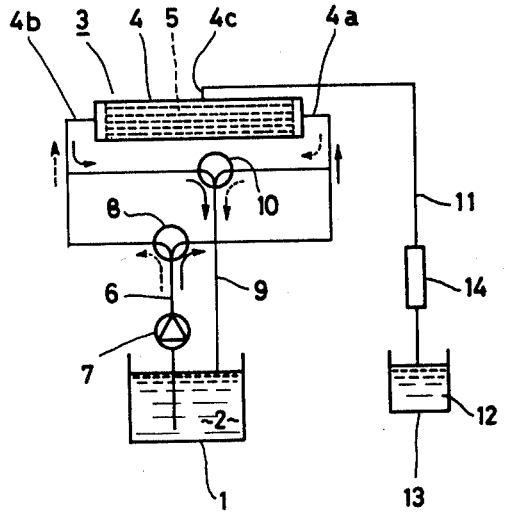

This invention relates to the replenishment of an electrodeposition bath and more particularly it concerns a method and apparatus for replenishing an electrodeposition bath liquid containing as essential components a cationic basic resin and at least one non-ionic resin in the form of fine powder and having been changed with time.

There is known (U.S. Pat. No. 3,869,366 dated Mar. 4, 1975) a method for coating an electrically conductive article with a resinous material by electrodeposition which comprises immersing said article as the cathode in an aqueous bath containing, as essential components, (1) a water-thinnable cationic binder resin which is a nitrogen atom-containing resin neutralized at least partially with an acid compound and (2) at least one non-ionic resin in the form of powder which is solid at room temperature but which can melt when heated to form a film, the non-ionic resin powder being used in excessively large quantities as compared with said cationic binder resin, and applying a voltage between said cathode and an anticorrosive electrical conductor as an anode through said bath, so that said cationic binder resin and non-ionic resin powder are deposited on the surface of the article.

Such cationic electrodeposition system wherein a cationic binder resin is used is advantageous over heretofore known other electrodeposition coating methods in that:

(1) The Coulomb efficiency is very high and therefore, a good coating film can be obtained in a very short period of time;

(2) The coating film properties are excellent;

(3) The hygienic qualities in connection with the working atmosphere are excellent as compared with those of other conventional powder coating methods; and (4) The operation is safe because of the inflammable materials involved.

In carrying out such cationic type electrodeposition, the article to be coated and anode are dipped into an aqueous bath having a solid content of 10–20% by weight and a voltage is applied therebetween to cause direct current to flow through said bath, thereby allowing deposition of a film coat onto said article.

However, when such cationic type electrodeposition coating is carried out continuously, the bath liquid becomes contaminated with time because of the dissolution of the contaminants in the article to be coated into said bath, accumulation of neutralizer, i.e. acid compound, which is used for making the basic resin soluble or thinnable in water, in the bath, and decomposition of bath components, and as a result thereof the coated film will get worse in respect to the finish and properties thereof.

As a method for replenishing thus deteriorated bath liquid, a part or whole of the bath is usually replaced by a fresh bath liquid. However, such method is quite uneconomical because of the waste of the active ingredients still contained in the bath composition discarded. It is, therefore, practically important to find out a method for replenishing an electrodeposition bath, before being contaminated thoroughly, in a continuous way.

In the usual continuous method for the electrodeposition coating of an electrically conductive article, the composition of the components in the electrodeposition bath will vary with the time and in general, the concentration of neutralizer, i.e. acid compound in the bath will be increased. For example, with the progress of continuous electrodeposition, the basic resin (binder resin) and fine synthetic non-ionic resin powder will be consumed due to the deposition on the article but the acid compound used to render the basic resin water-thinnable to prepare the binder resin will not be decreased at the same rate so that there is caused fluctuation in the bath composition. Consequently, the proportion of the said compound relative to the basic resin in the bath will continuously be increased and the concentration of said acid in the bath will be increased accordingly. Under such conditions, the finish and properties of the final coating film will be adversely affected.

In order to prevent the undesirable accumulation of the neutralizer in the bath and overcome the abovementioned drawbacks, there were proposed various countermeasures as, for example, a replenishment method using a replenishing supply liquid with a lower concentration of neutralizer; a diaphragm method using a permeable membrane and counter-electrode to electrically remove the neutralizer in the bath out of the system and an ion-exchange method using an ion-exchange resin for the removal of the neutralizer in the bath. However, in the heretofore proposed replenishment method, there are difficulties in the preparation of replenishing supply liquid per se and in the adjustment of the liquid characteristics of the bath replenished, since the bath intended in the present invention contains a relatively lower concentration of the neutralizer in substance. The second diaphragm method raises vexing problems relative to the maintenance of equipment and the third ion-exchange method is troublesome due to clogging with resin particles.

Therefore, a novel and efficient method has long been desired for the replenishment of a electrodeposition bath to be used in a continuous electrodeposition method.

In an electrodeposition coating method, the electrically conductive article is usually pre-treated with a composition containing a degreasing agent (including sodium silicate and caustic soda), phosphoric acid, zinc, iron ions and the like. These chemicals are, however, prone to be transferred from the article to the electrodeposition bath during the electrodeposition operation. The inclusion of such materials and especially of cations in the bath will exert a great influence on the bath liquid characteristics, cause an increase in reactive current in the electrodeposition step and bring about chemical changes in the bath or coating film, thereby resulting in the deterioration of the electrodeposition characteristics such as finishing, as well as determination of the properties of the final coating film, and the like. Various attempts have been made to eliminate the possible inclusion of these harmful chemicals in the bath, but these attempts have failed to obtain satisfactory results. Therefore, it has also long been desired to have an effective means capable of removing such harmful substances from the bath in a continuous way. The abovementioned substances will be further changed with time in the bath through hydrolysis or other chemical reactions and the deterioration of electrodeposition characteristics will be advanced accordingly.

Regarding the change in the composition of the electrodeposition bath with time, there still remains various unknown matters and its exact mechanism has not yet been solved out. In a conventional bath, various chemical changes of the cationic synthetic resin are believed to be the main cause of the deterioration of the bath. However, in the present electrodeposition bath, the content of cationic synthetic resin is not so high as in a conventional bath containing no non-ionic resin powder. Therefore, in this case, that may not be the real cause. Under such conditions, the basic resin is prone to be adsorbed onto the resin powder, which must be the main cause of such deterioration of bath.

In general, the basic synthetic resin is partially neutralized with an acid compound to give a neutralization degree of about 50–70% and the thus partially neutralized cationic resin is used for the preparation of the electrodeposition bath. (The measurement of the neutralization degree will be explained later.) As already stated, if there is, with the elapse of time, fine resin powder bearing excessive amounts of basic synthetic resin adhered or absorbed thereon in the bath, the finishing and properties of the final coating film would be extremely contaminated. Therefore, in the related field, there has long been desired a method for removing harmful substances from an electrodeposition bath in a continuous way.

Therefore it is an object of this invention to provide a method by which the above explained problems are solved.

It is also an object of the present invention to provide an apparatus useful for the above method.

Figure 2:
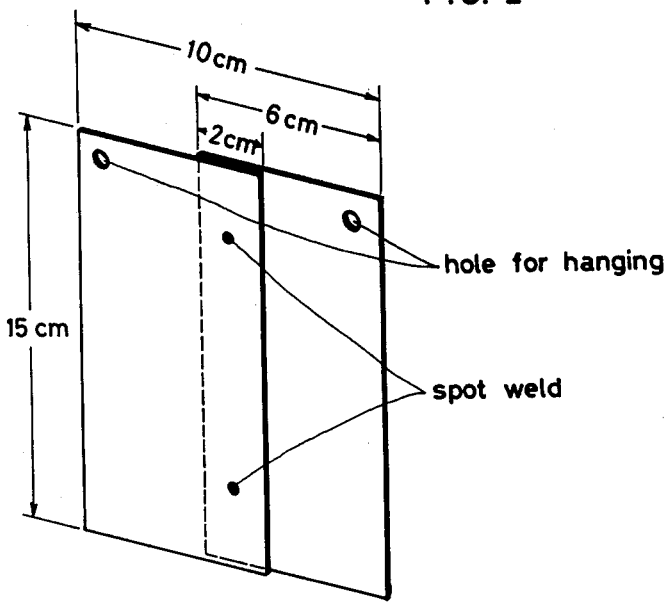

Other objects of this invention will be apparent from the following description which will be made by referring partly to the accompanying drawings wherein:

FIG. 1 is a schematic block diagram showing an apparatus embodying this invention; and FIG. 2 is a schematic view of a zinc treated iron sheet used in Example 2.

Briefly this invention provides a method for replenishing an electrodeposition coating liquid which comprises subjecting an electrodeposition bath liquid containing: as essential components, a water thinnable cationic binder resin which is a nitrogen atom-containing basic resin neutralized at least partially with an acid compound and at least one non-ionic resin in the form of powder which is solid at the room temperature but can melt when heated to form a film and having been deteriorately changed with time, to an ultrafiltration, recycling the thus obtained concentrate for the purpose of adjustment of the liquid characteristics of the bath and using the filtrate as a diluent for replenishing the supply liquid or as a rinsing liquid (washing liquid) for the coated article or for the purpose of discarding it.

According to another aspect of this invention, the ultrafiltration is carried out with an apparatus having a cylindrical filter containing at the opposite ends an inlet for the bath liquid and an outlet for the filtered concentrate and at the side wall an exit for the filtrate, a conduit means for supplying the bath liquid alternately to said inlet or outlet through a switch valve, a conduit means for allowing the filtered concentrate out from said outlet or inlet end alternately through a switch valve, a conduit means connected to said exit for allowing the filtrate out, and a sensing means connected to the last mentioned conduit, sensing the flow rate of the filtrate and being able to send a signal according to the significant change in the sensed flow rate to actuate the abovementioned switch valves in opposite directions.

Thus, we have succeeded in solvent out the abovementioned problems by subjecting the deleteriously changed electrodeposition bath liquid to an ultrafiltration operation. Thus, in the present invention, there is provided a method for replenishing an electrodeposition coating liquid which comprises subjecting an electrodeposition bath liquid containing, as essential components, a water-thinnable cationic binder resin which is a nitrogen atom-containing basic resin neutralized at least partially with an acid compound and at least one non-ionic resin in the form of powder which is solid at the room temperature but can melt when heated to form a film and having been deteriorated with time, to a ultrafiltration using a porous filter material having an average pore diameter of 0.001 to 2.0 microns, recycling thus obtained concentrate for the purpose of adjustment (conditioning) of liquid characteristics of said bath and using the filtrate containing the deleteriously changed basic resin, an excess amount of an acid compound and other harmful impurities as a diluent for replenishing the supply liquid or as a rinsing liquid (washing liquid) for coated articles or to direct it into a discard means.

According to the present invention, it is preferable that, prior to the ultrafiltration, the neutralization degree of basic resin is increased to a higher level by the addition of an acid compound to the bath, thereby causing the separation of the excessively adhered or adsorbed basic resin from the fine resin powder and dissolving the same into the bath. This may also be understood by referring to the fact that the higher the neutralization degree, the greater the replenishing effect.

The amount of acid compound to be added in the first step of this invention is not critical provided that it is sufficient enough to dissolve the basic synthetic resin excessively adhered to the fine resin powder. It is, however, generally selected in a range which is capable of neutralizing the basic resin to a neutralization degree of 80% or enough to increase the neutralization degree of the basic resin in the bath to be treated by 20% or more. In general, the separation and dissolution of said basic synthetic resin will increase proportionally with the increase in the neutralization degree over that level. Therefore, a far better result may be obtained when the amount of acid compound is increased to the quantity which is enough to increase the neutralization degree by 40% and more. In order to get a complete dissolution of said basic resin with the acid compound, it is usually sufficient enough to continue stirring of the bath for about 4 hours and more. This stirring time is, however, not critical in the invention, and may, of course, vary with the deterioration degree of the bath liquid to be treated.

As for the acid compound to be used in the abovementioned step, one may select any kind of acid compound including organic and inorganic acids. However, preference is given to the same acid compound as used in the preparation of a partially neutralized cationic resin for the initial bath since there is no fear of inclusion of different kinds of acid compounds in the bath. Examples of said acid compounds are such organic acids as formic acid, acetic acid, propionic acid, citric acid, malic acid, tartaric acid and lactic acid, and such inorganic acids as phosphoric acid, hydrochloric acid, sulfuric acid and boric acid.

In adding an acid compound to the bath, the neutralization degree of the basic resin in the deleteriously changed bath liquid is first determined and then the acid compound is added in an amount sufficient to increase the neutralization degree of the bath as stated hereinbefore.

According to this invention, as the second step, the thus acid-added bath liquid is subjected to ultrafiltration (hereinafter abbreviated as UF), thereby obtaining a filtrate and a concentrated residual liquid. The filtrate contains the deleteriously changed cationic resin an excess amount of acid compound and other harmful impurities and this is used as a diluent for replenishing the supply liquid, or rinsing liquid for coated articles or is thrown into a discard. The remained concentrate is added with a replenishing supply liquid and recycled for the purpose of adjustment of the liquid characteristics of the electrodeposition bath liquid.

In carrying out the ultrafiltration, any commercial ultrafiltration apparatus having a tube, a coil or a plate structure made of porous filter material with an average pore diameter of 0.001 to 2 microns may be used, as, for example, Emby (trade mark of Fujiyu K.K.), Abeor (trade mark of Japan Abcor Co.), Yumicron (trade mark of Yuasa Denchi K.K.) and the like. Generally the ultrafiltration is conducted at a pressure of 0.2–3.0 $kg/cm^2$. However, it is preferable that the filter apparatus to be used in the present invention gives a constant flow rate of filtrate. For this end, conventional filtering methods are insufficient because the filtration rate is lowered due to the clogging of the filter with time. We, therefore, have studied this subject matter and found a very effective way of overcoming this problem. That is, in the present invention, it is preferable that the electrodeposition bath liquid to be filtered is supplied alternatively to an inlet or an outlet end of the filter via switch valve actuated automatically in opposite directions according to the flow rate change of the filtrate, thereby obtaining a constant flow rate of the filtrate very easily and accurately.

Such filtration may be carried out effectively by using a preferable type of apparatus as shown in FIG. 1. In the drawing, 1 is an electrodeposition liquid tank, 2 is an electrodeposition bath liquid and 3 is a ultrafilter placed above said tank 1. This filter 3 comprises casing 4 having an inlet 4a for bath liquid at one end, an outlet 4b for the concentrate at the other end, and an additional exit 4c for the filtrate at the side wall thereof, and bag-like ultrafilter 5 placed in said casing as filter cartridge. The bath liquid supplied via inlet 4a to the filter 5 is filtered and the filtered concentrate is discharged from outlet 4b and the filtrate is discharged from exit 4c. 6 is a conduit means for supplying the bath liquid from said tank 1 to said filter 3 and 7 is a pump means for pumping the bath liquid. This bath liquid can be supplied via three-way switch valve 8 to either inlet 4a or outlet 4b. 9 is a conduit means for recovering the filtered concentrate discharged from said filter 3 into said bath liquid tank 1. This conduit is connected via three-way valve 10 to both inlet 4a and outlet 4b of the filter 3. 11 is an additional conduit means for recovering the filtrate 12 discharged from exit 4c of the filter 3 to a separately positioned filtrate tank 13, and 14 is a filtrate flow rate sensor positioned in the midst of the pathway to tank 13, which senses the flow rate in line 11 and actuates said switch valves 8 and 10 in opposite directions when the flow rate of filtrate in line 11 gets lower than the pre-determined level.

The working sequences are as follows. Under normal conditions, the bath liquid supplying line 6 is connected via three-way valve 8 to inlet 4a of filter 3 and the concentrate recovering line 9 is connected via three-way valve 10 to the outlet 4b of the filter 3, as shown in solid arrow line. The bath liquid 2 in tank 1 is pumped by means of pump 7, entered into the filter cartridge 5 and filtered therein. The filtrate 12 is discharged from exit 4c, recovered in filtrate tank 13 and thereafter used in various purposes as already stated. The filtered concentrate is discharged from outlet 4b and returned to the bath liquid tank 1 through line 9. When the filtration is continued, the resin powder component in bath liquid 2 will be gradually accumulated on the inlet 4a side of the filter 5 and the flow rate of filtrate 12 in line 11 will be decreased proportionally, which is detected by said sensor 14. At the time when the flow rate of filtrate 12 in line 11 drops to a certain pre-determined level, the sensor 14 will give a signal which actuates the three-way valves 8 and 10 in opposite directions, allowing the bath liquid 2 in tank 1 to flow to the outlet 4b of the filter 3 and the filtered concentrate to discharge from the inlet 4a, as shown by dotted arrow line in FIG. 1. Thus, the clogging of filter 5 will disappear, the desired flow rate of filtrate be regained, and a very effective filtration may be carried out in continuous way.

Though the composition of filtrate thus obtained by the practice of the present invention may somewhat vary with the particular apparatus actually used, the solid content is, in general, in the order of less than 1 wt.%, the acid content is about 50% of the quantities initially present in the deleteriously changed bath liquid, and the harmful cations as alkali and alkaline earth metals do correspond to about 70% by weight of the amounts initially found in the deleteriously changed bath liquid.

As for the details about the electrodeposition process wherein the cationic binder resin is used, reference may be made to U.S. Pat. No. 3,869,366. However, it may be briefly explained as follows.

Thus, examples of the basic resins to be used in the present invention are amine-added epoxy resins (amino-epoxy resins), aminoacryl resins, polyamide resins and the lime. The non-ionic synthetic resins in the form of powder and to be used together with the basic resins are, for example, epoxy resins, polyester resins, polyurethane resins, acrylic resins, and etc. These resins are, however, not to be taken as limitative in the present invention.

Examples of the acid compounds to be used for the partial neutralization of the basic synthetic resins to form the cationic binder resins are formic acid, acetic acid, propionic acid, citric acid, malic acid, tartaric acid, phosphoric acid, hydrochloric acid, sulfuric acid and boric acid, but any other organic and inorganic acids may also be used.

In carrying out the electrodeposition, the following conditions are generally used.

| | |
|---|---|
| Solid content in the bath | 10–20% by weight |
| pH | 4.5–6.0 |
| Weight ratio of basic synthetic resin to non-ionic powder | 1:1–1:10 |

The bath is maintained at 20°–30° C. and a voltage is applied between the cathode (article to be coated) and corrosion-resistant anode (for example, stainless steel or carbon electrode) to cause direct current (about 50–600 V) to flow through said bath for 5 to 30 seconds. The thus obtained coated article is washed with water, hydro-extracted, dried and then subjected to baking under predetermined conditions.

The invention will be further explained by referring to the following examples wherein all parts are by weight unless otherwise specified.

(A) Determination of the basicity value of the basic resin:

About 1 g. of acid free unneutralized basic resin is taken in an Erlenmeyer flask and dissolved in 60 c.c. of dioxane (if required, under heating). After adding a few drops of methyl red solution, the solution is titrated with 1/10 n HCl. The acid volume (c.c.) required up to the discoloring point is, after being calculated in terms of c.c. per gram of basic resin, used as a basicity value of the tested resin.

(B) Determination of the acid value of the bath liquid:

The electrodeposition bath liquid is first ultra-centrifuged (rotation 1,000 rpm and over) to obtain a supernatant liquid. 20 c.c. of said supernatant are taken in an Erlenmeyer flask and added with 100 c.c. of dioxane. After mixing well, a few drops of thymol blue solution is added and the solution titrated with a 0.1 N KOH alcoholic solution up to a discoloring point. The required alkaline solution (c.c.) is, after converting to c.c. per gram of solid component, used as an acid value of the bath liquid.

(C) Calculation of the neutralization degree:

$$\text{Neutralization degree} = \frac{\text{Acid value of the bath}}{\text{Basicity value of basic resin}} \times 100$$

EXAMPLE 1

(1) Production of a water-dilutable cationic binder resin

253 Parts of Epikote 1001 (trade mark of aminoepoxy resin supplied by Shell Chemical Co.), 47 parts of diethanolamine and 128 parts of isopropyl alcohol were reacted at 85°–90° C. for 4 hours to obtain a liquid aminoepoxy resin. 20 Parts of propionic acid and 552 parts of pure water were then added thereto to obtain a water-dilutable cationic binder resin liquid of 30 wt% solid content and a neutralization degree of 60%.

(2) Preparation of a non-ionic fine synthetic resin powder

88 Parts of Epikote 1007 (trade mark of aminoepoxy resin supplied by Shell Chemical Co.), 262 parts of Epikote 1004 (trade mark of aminoepoxy resin supplied by Shell Chemical Co.), 0.7 part of Miki-levelling conc. (trade mark of surface levelling agent of Kyoeisha Oil & Fat Chem. Co.), 18 parts of dicyandiamide, 137 parts of Titanium oxide R-550 (trade mark, product of Ishihara Sangyo-Sha) and 3 parts of Carbon black MA-100 (trade mark of Mitsubishi Chemical Co.) were melted together and kneaded in an extruder in a conventional way. The product was crushed with a crusher to obtain a fine epoxy resin powder having an average size of 7 microns.

(3) Preparation of the electrodeposition bath

710 Parts of pure water were added to 355 parts of the water-dilutable cationic resin obtained in (1) and the mixture was well agitated with a dissolver to obtain a water-dilutable cationic resin liquid having 10% by weight of a solid content. This liquid was gradually added to 373 parts of the fine epoxy resin powder obtained in (2). The mixture was agitated for about 30 minutes, and additional 1762 parts of pure water were added thereto and the mixture was adjusted to contain 15% by weight of solid matter. The characteristics and electrodeposition characteristics of the thus obtained electrodeposition bath liquid (I) are shown in Table 1.

The above bath liquid (I) was maintained at 30° C. and bubbled with air for 20 days to cause a deleterious change of the bath liquid. The thus obtained bath liquid (II), whose neutralization degree was 44%, was used in a way similar as that of liquid (I) for the electrodeposition of the electrically conductive article. The coating film had a non-uniform, discrete citrous-like appearance. The characteristics and electrodeposition characteristics of this bath liquid (II) are also shown in Table 1.

(4) Present method

Step 1

6.6 Parts of propionic acid were added to the abovementioned bath liquid (II) to increase the neutralization degree to 100%. The continuous supply of air was stopped and the mixture was stirred well. The characteristics of thus obtained bath liquid (III) are shown in Table 1.

Step 2

The bath liquid (III) was then subjected to an ultrafiltration using a UF apparatus to remove the deleteriously changed basic resin and excess amounts of the acid compound therefrom. As a UF apparatus, use was made of the Emby UF apparatus (trade mark of Fujiyu K.K.). The operation pressure was 0.8 kg/cm$^2$ and the filter cartridge used possessed an average pore diameter of 0.8 microns. Using this UF apparatus, 1500 parts of filtrate were first removed from the bath liquid (III) and the recovered concentrate was added with 1500 parts of pure water, from which an additional 1500 parts of filtrate were again removed out of the system. The characteristics of the thus obtained bath liquid (IV) are shown in Table 1. The solid content of the thus separated filtrate was 0.5% by weight and the filtrate contained acid as much as almost 50% by weight of the total acids found in the initial bath liquid before UF treatment. Next, the bath liquid (IV) was added with 50 parts of the abovementioned cationic resin and 1450 parts of pure water to obtain the liquid (V). When used this liquid (V) in an electrodeposition, process a coating film having a beautiful and smooth surface was obtained. The characteristics and electrodeposition characteristics of the bath liquid (V) are as shown in Table 1.

Table 1

| | Bath liquid | | | | |
|---|---|---|---|---|---|
| | (I) | (II) | (III) | (IV) | (V) |
| Liquid characteristics: | | | | | |
| Solid contents (wt %) | 15 | 15 | 15 | 27.3 | 15 |
| pH | 5.15 | 5.6 | 4.8 | 5.05 | 5.10 |
| PO/Bi* (wt ratio) | 3.5/1 | 3.5/1 | 3.5/1 | 4.0/1 | 3.5/1 |
| Neutralization degree (%) | 60 | 44 | 100 | 68 | 66 |
| Total volume of bath (parts) | 3200 | 3200 | 3200 | 1700 | 3200 |
| Electrodeposition characteristics: | | | | | |

Table 1-continued

| | Bath liquid | | | | |
|---|---|---|---|---|---|
| | (I) | (II) | (III) | (IV) | (V) |
| Film thickness (microns) | 56–58 | 95–110 | | | 50–52 |
| Coulombefficiency (mg/c) | 74 | 118 | | | 71 |
| Coating film appearance | beautiful smooth & uniform | non-uniform discrete citrous-skin | | | beautiful smooth & uniform |

Electrodeposition conditions: 200 V, 15 seconds, 25° C.
Baking conditions: 5 minutes at 80° C. ; increased to 200° C. in 13 minutes and maintained at 200° C. for 15 minutes.
*PO/Bi is a weight ratio of the fine non-ionic synthetic resin powder to the water-dilutable cationic binder resinin the electrodeposition bath liquid.

EXAMPLE 2

A water-dilutable cationic binder resin and non-ionic fine epoxy resin powder were prepared as in Example 1. 400 Parts of said cationic resin were added with 800 parts of pure water and the mixture was well agitated with agitating means to obtain a water-dilutable cationic resin liquid of 10% by weight solid content. This resin liquid was gradually added to 360 parts of the abovesaid fine epoxy resin powder and the mixture was agitated for about 30 minutes. Thereafter, the mixture was added with 1640 parts of pure water to obtain a diluted bath liquid (I) having 15% by weight of solid content. The characteristics and electrodeposition characteristics of the bath liquid (I) are shown in Table 2.

Using this bath liquid (I) and using as a cathode a zinc treated test plate as shown in FIG. 2, an electrodeposition was carried out. In this case, said test plate was prepared by a conventional zinc plating method and used in a wet state without drying the same. The electrodeposition was carried out under the following conditions:

| | |
|---|---|
| Voltage | 250 V |
| Time | 10 seconds |
| Temperature | 25° C. |

When 50 test pieces were coated, the bath liquid characteristics and electrodeposition characteristics were determined after said operations. It was observed that as shown in Table 2, the ratio of acid to water-dilutable cationic resin in the bath was increased, the coating film thickness was reduced and the balance of the components in the bath was lost out. This bath liquid is referred to as (II). In this bath liquid (II), it was observed that the Na ion concentration was 24 ppm, the Zn ion concentration was increased from 0.5 ppm to 11 ppm and the Fe ion concentration was also increased from 0.5 ppm to 6 ppm. This is believed to be due to the fact that metal ions deposited on the surface of each test specimen or entered into the gap between the superpositioned test specimens are dissolved out and transfered into the bath liquid.

Next, the bath liquid (II) was filtered by using an ultrafiltration apparatus (Abcor, an average pore diameter 8 microns, manufactured by Japan Abcor Co.) and 800 parts of the filtrate were taken out. The characteristics of the thus treated bath liquid (III) are shown in Table 2. The solid content of said filtrate was 0.5% by weight and the acid contents did correspond to 50% by weight of the total acids initially found in the electrodeposition bath. Various metal ion concentrations are as shown in Table 2.

The bath liquid (III) was then added with 127 parts of the abovementioned cationic resin, 110 parts of the non-ionic fine resin powder and 863 parts of pure water to obtain a bath liquid (IV), which was used in an electrodeposition. The coated article was washed with a mixture of said filtrate and water, and subjected to a baking under the conditions as stated in Example 1. Again, a beautiful, uniform coating film was obtained. The liquid characteristics and electrodeposition characteristics of the bath liquid (IV) are shown in Table 2.

Table 2

| Characteristics | Bath liquid | | | | |
|---|---|---|---|---|---|
| | (I) | (II) | filtrate | (III) | (IV) |
| Solid content (wt %) | 15.0 | 11.6 | 0.5 | 15.8 | 15.0 |
| pH | 5.15 | 5.05 | | 5.10 | 5.12 |
| PO/Bi* ratio | 3.0/1 | 2.9/1 | | 3.05/1 | 3.0/1 |
| Neutralization degree (%) | 60.0 | 72 | | 65 | 63.4 |
| Liquid volume (parts) | 3200 | 2900 | | 2100 | 3200 |
| Na ion (ppm) | 2 | 24 | 24 | 10 | 7 |
| Zn ion (ppm) | less than 0.5 | 11 | 11 | 6 | 3 |
| Fe ion (ppm) | less than 0.5 | 6 | 1 | 4 | 2 |
| Electrodeposition | 250 V, | 10 seconds, | | 25° C. | |
| Coulomb efficiency (mg/c) | 68.0 | 51.0 | | | 65.0 |
| Film thickness (microns) | 70–72 | 52–53 | | | 68–70 |
| Appearance of film | uniform beautiful smooth | thin citrous skin | | | uniform beautiful smooth |

*PO/Bi weight ratio of fine non-ionic resin powder to cationic resin.

EXAMPLE 3

A zinc phosphate treated steel test piece of 70×150×0.8 mm was connected to a cathode and was subjected to electrodeposition by using the bath liquid (I) described in Example 1 (the liquid characteristics and electrodeposition characteristics being shown in Table 3), with an impressed voltage of 200 V at a bath temperature of 25° C. for 10 seconds. When 100 test pieces were coated, the coating film of the last test piece was thinner than those of the initial stages and the film appearance was non-uniform and of citrous skin. The characteristics of the thus obtained bath liquid (II) were determined and it was found that the solid content was 12% by weight, the neutralization degree was 70%, the bath liquid volume was 2900 parts, the cationic resin solid was 87 parts and the non-ionic fine resin powder was 261 parts. The characteristics and electrodeposition characteristics of the bath liquid (II) are shown in Table 3.

Replenishment of the bath liquid was carried out as follows: 253 Parts of Epikote 1001 (trade mark of epoxy resin of Shell Chemical Co.), 47 parts of diethanol amine and 128 parts of isopropanol were reacted under reflux at 85°–90° C. for 4 hours to obtain a liquid amino-epoxy resin. Then, 13 parts of propionic acid and 59 parts of pure water were added thereto to obtain a water-dilutable cationic resin of 60% solid content and a neutralization degree of a 40%. As a UF filtrate, was used a liquid derived from the bath and having the same composition with that of said liquid (II). This was obtained by using the apparatus as shown in FIG. 1 and by changing the three-way valves in opposite directions several times during the course of filtration. (Operational pressure 0.8 kg/cm$^2$; average pore diameter of the filter 0.8 micron). The thus obtained filtrate contained 0.5 wt % of solid and 50% of acid initially contained in the bath liquid. Then 30 parts of the abovesaid UF filtrate (solid content 0.15 part) were gradually added to 33 parts of the abovementioned replenishing supply cationic resin liquid (solid content 19.8 parts) with stirring and the mixture was agitated well to obtain a liquid having a 32 wt% solid content and a neutralization degree of 43%. Thereafter, 50 parts of the abovementioned bath liquid (II) were added gradually under stirring and thus obtained mixture was sent back to bath liquid (II) and stirring was continued for an additional 30 minutes. 150 Parts of the thus obtained liquid was gradually added with 112 parts of the abovementioned non-ionic fine resin powder and the mixture was agitated well, sent back to the bath, added with 125 parts of pure water and stirred for an additional 1 hour. The thus prepared bath liquid is referred to as (III).

When an electrodeposition was carried out with this bath liquid (III), an excellent coating film having a uniform, beautiful appearance was obtained as in the case with bath liquid (I). The characteristics and electrodeposition characteristics of the bath liquid (III) are shown in Table 3. The solid content of the bath liquid (III) was 15% by weight and the neutralization degree was 65%.

Table 3

| | Bath liquid | | |
|---|---|---|---|
| | (I) | (II) | (III) |
| Liquid characteristics: | | | |
| solid contents (%) | 15 | 12 | 15 |
| PO/Bi | 3.5/1 | 3.0/1 | 3.5/1 |
| pH | 5.0 | 4.7 | 4.9 |
| Neutralization degree (%) | 60 | 70 | 65 |
| Bath volume (parts) | 3200 | 2900 | 3200 |
| Non-ionic resin powder (parts) | 373 | 261 | 373 |
| Cationic resin (parts) | 106.5 | 87 | 107 |
| Electrodeposition characteristics: | | | |
| Electrodeposition conditions | 200 V, | 10 seconds, | 25° C. |
| Film thickness (microns) | 54–56 | 38–43 | 50–52 |
| Coulomb efficiency (mg/c) | 74 | 65 | 70 |
| Baking conditions | 5 min. at 80° C., increased to 200° C. in 13 min. and maintained at 200° C. for 15 min. | | |
| Appearance | beautiful smooth uniform | thin citrous skin basic resin rich | beautiful smooth uniform |

What we claim is:

1. A method for replenishing an electrodeposition coating liquid bath which comprises subjecting to ultrafiltration, in an ultrafiltration apparatus, an electrodeposition bath liquid which has been decomposed with time, said bath containing, as essential components, a water thinnable cationic binder resin which is a nitrogen atom containing a basic resin neutralized at least partially with an acid compound and at least one non-ionic resin in the form of a powder which is solid at room temperature, but which can melt when heated to form a film, said ultrafiltration being carried out under a pressure of 0.2–3.0 kg/cm$^2$; changing the direction of the bath liquid during the ultrafiltration step so as to cause the liquid to flow in opposite directions in the ultrafiltration apparatus for the purpose of preventing the clogging of the apparatus; recycling the concentrates obtained from the ultrafiltration to the electrodepostion coating bath to adjust the liquid characteristics of the bath and using filtrates obtained from the ultrafiltration step as a diluent for preparing a replenishing supply liquid and adding the thus-prepared replenishing supply liquid to the electrodeposition coating bath.

2. A method as claimed in claim 1 wherein the ultrafiltration is carried out with an apparatus having a cylindrical filter having at the opposite ends an inlet for the bath liquid and an outlet for the filtered concentrate and at the side wall an exit for the filtrate, a conduit means for supplying the bath liquid alternately to said inlet or outlet through a switch valve, a conduit means for allowing the filtered concentrate out from said outlet or inlet and alternately through a switch valve, a conduit means connected to said exit for allowing the filtrate out, and a sensing means connected to the last mentioned conduit, sensing the flow rate of the filtrate and means to send a signal according to the significant change in the sensed flow rate to actuate the abovementioned switch valves in opposite directions to reverse the direction of the liquid flow through the cylyndrical filter so as to eliminate any clogging within the filter.

* * * * *